US006678650B2

(12) United States Patent
Inoue

(10) Patent No.: US 6,678,650 B2
(45) Date of Patent: Jan. 13, 2004

(54) APPARATUS AND METHOD FOR CONVERTING REPRODUCING SPEED

(75) Inventor: Akira Inoue, Tokyo (JP)

(73) Assignee: Sony Corporation, Tokyo (JP)

( * ) Notice: Subject to any disclaimer, the term of this patent is extended or adjusted under 35 U.S.C. 154(b) by 473 days.

(21) Appl. No.: 09/802,295

(22) Filed: Mar. 9, 2001

(65) Prior Publication Data

US 2001/0032072 A1 Oct. 18, 2001

(30) Foreign Application Priority Data

Mar. 13, 2000 (JP) ..... P2000-073985

(51) Int. Cl.[7] ..... G10L 21/00; G10L 19/00
(52) U.S. Cl. ..... 704/211; 704/207; 704/271
(58) Field of Search ..... 704/207, 211, 704/271; 381/23.1

(56) References Cited

U.S. PATENT DOCUMENTS 5,717,818 A * 2/1998 Nejime et al. ..... 704/211

* cited by examiner

*Primary Examiner*—Susan McFadden
(74) *Attorney, Agent, or Firm*—Jay H. Maioli

(57) ABSTRACT

An apparatus and method for converting the speed of reproducing an input acoustic signal. The apparatus and method can efficiently delay the output signal without using an output-data storage section of a large storage capacity even if the input acoustic signal has a high sampling frequency. In the apparatus, the speech-speed converting section generates an acoustic frame signal s6 which has been converted in speech speed and which has a predetermined length. The frame-signal encoding section encodes the acoustic frame signal s6 generated by the speech-speed converting section, thereby generating coded data s10 that is smaller than the data represented by the acoustic frame signal s6. The coded data storage section stores the coded data s10. The frame-signal decoding section decodes the coded data s11 read from the storage section, generating an output acoustic signal s9 having a particular length.

9 Claims, 8 Drawing Sheets

APPARATUS AND METHOD FOR CONVERTING REPRODUCING SPEED

BACKGROUND OF THE INVENTION

The present invention relates to an apparatus for converting the speed of reproducing an acoustic signal. More particularly, the invention relates to an apparatus and method for processing an acoustic signal in real time, thereby to reproduce the signal at a lower speed than the signal has been generated.

Speech speed converters that convert speech speed in real time are used for various purposes. More specifically, a speech speed converter is used to help people learn foreign languages, to assist elderly persons with weakening hearing and aurally handicapped persons, or to enable people of different mother tongues to communicate with one another. The real-time speech speed converter reproduces any voiced part of an input acoustic signal at a lower speed than the voiced part has been produced (by means of time expansion) and any voiceless part of the input acoustic signal at a higher speed than the voiceless part (by means of time compression). Thus, the converter changes the acoustic signal to one that represents a more distinct and perceivable speech sound. One of the essential functions of the speech speed converter is to compensate the delay of the output signal, which has resulted from the time expansion of the voiced part, in the process of time-compressing the voiceless part of the acoustic signal. This makes it possible to minimize the time difference between the original speech sound and the reproduced speech sound.

A conventional real-time speech speed converter will be described, with reference to FIG. 1.

As shown in FIG. 1, the real-time speech speed converter comprises an input terminal In, an input section 1, a data storage section 2, a characteristic detecting section 3, and a calculation section 4. The input section 1 receives an acoustic signal s1 supplied to the input terminal In. The data storage section 2 stores the acoustic frame signal s1 in the form of an acoustic frame signal s2 that has a particular length. The characteristic detecting section 3 receives the acoustic frame signal s2 read from the data storage section 2 and detects the characteristic s3 of the acoustic frame signal s2. The characteristic s3 detected is supplied to the calculation section 4. The calculation section 4 receives a write-position signal s7 and a read-position signal s8, too. (The signals s7 and s8 will be described later.) The calculation section 4 calculates a speech-speed converting rate s4 from the characteristic s3.

As FIG. 1 shows, the real-time speech speed converter further comprises a speech-speed converting section 5, an output-data writing section 6, an output-data storage section 7, an output-data reading section 8, and an output section 9. The speech-speed converting section 5 receives an acoustic frame signal s5 read from the data storage section 2. The speech-speed converting section 5 processes the acoustic frame signal s5 in accordance with the speech-speed converting rate s4, thereby generating an acoustic frame signal s6 that has a specific length. The acoustic frame signal s6, thus generated by the section 5. The output-data storage section 7 stores the output signal of the speech-speed converting section 5 as an acoustic frame signal s6 converted in terms of speech speed, as is illustrated in FIG. 2. The output-data writing section 6 generates a write-position signal s7 that designates the position where the signal s6 should be written in the output-data storage section 7. In the output-data storage section 7, the acoustic frame signal s6 is written at the position designated by the write-position signal s7. The output-data reading section 8 generates a read-position signal s8 that designates the position from where an output acoustic frame signal s9 should be read from the output-data storage section 7. The acoustic frame signal s9 is read from the output-data storage section 7, at the position designated by the read-position signal s8. The acoustic frame signal s9, thus read, is output through the output section 9.

The output-data storage section 7 has a large storage capacity. The section 7 stores the delayed part of the acoustic frame signal s9 (i.e., the time-expanded, voiced part). The output-data storage section 7 is, for example, a semiconductor memory. In order to lower speech speed as much as desired, the real-time speech speed converter shown in FIG. 1 needs to have an output-data storage section, e.g., a semiconductor memory, which has a sufficient storage capacity. Without such an output-data storage section 7, the speech speed converter cannot allow for some delay of the output acoustic signal.

The input acoustic signal s1 may be a multi-channel signal. The sampling frequency may be comparatively high. In either case, the output-data storage section 7 must be an expensive one that can serve to lower the speech speed as much as desired. This would increase the manufacturing cost of the real-time speech speed converter.

For example, the input acoustic signal s1 may be a stereophonic 16-bit linear PCM signal that has sampling frequency of 44.1 kHz. In this case, the output-data storage section 7 needs to be a semiconductor memory of the storage capacity given by the following equation (1), in order to delay the output signal by 10 seconds.

$$16\times44100\times2\times10=1411200[\text{bit}]\approx1.7M[\text{byte}] \quad (1)$$

BRIEF SUMMARY OF THE INVENTION

The present invention has been made in consideration of the foregoing. An object of the invention is to provide an apparatus for converting the speed of reproducing the input acoustic signal, which can efficiently delay the output signal without using an output-data storage section of a large storage capacity even if the input acoustic signal has a high sampling frequency.

To achieve the object, a reproducing-speed converting apparatus according to the invention is designed to process the reproducing speed of an input acoustic signal in real time, thereby converting the reproducing speed to a speed lower than the reproducing speed of the original sound. The reproducing-speed converting apparatus comprises: characteristic detecting means for detecting the characteristic of an acoustic frame signal contained in the input acoustic signal and having a predetermined length; calculation mans for calculating a speech-speed converting rate from the characteristic of the input acoustic signal, which has been detected by the characteristic detecting means; speech-speed converting means for performing speech speed conversion on the acoustic frame signal in accordance with the speech-speed converting rate calculated by the calculation means, thereby to generate an acoustic frame signal converted in speech speed; signal encoding means for encoding the acoustic frame signal generated by the speech-speed converting means and having the predetermined length, thereby to reduce the amount of data; coded data storage means for storing the coded data generated by the signal encoding means; and signal decoding means for decoding the coded data read from the coded data storage means, thereby to generate an output acoustic frame signal having a predetermined length.

In the reproducing-speed converting apparatus, the signal encoding means performs an appropriate encoding method, thus encoding the acoustic frame signal generated by the speech-speed converting means and thereby to reduce the amount of data. Hence, the coded data storage means for storing the coded data need not have a large storage capacity. In other words, the apparatus can function as a real-time speech speed converter that can lower speech speed as much as desired even if the coded data storage means has but a small storage capacity.

A reproducing speed converting method according to the invention is designed to process the reproducing speed of an input acoustic signal in real time, thereby converting the reproducing speed to a speed lower than the reproducing speed of the original sound. The method comprising the steps of: detecting the characteristic of an acoustic frame signal contained in the input acoustic signal and having a predetermined length; calculating a speech-speed converting rate from the characteristic of the input acoustic signal, which has been detected in the step of detecting the characteristic; performing speech speed conversion on the acoustic frame signal in accordance with the speech-speed converting rate calculated in the step of calculating the speech-speed converting rate, thereby to generate an acoustic frame signal converted in speech speed; encoding the acoustic frame signal generated by means of the speech-speed conversion, thereby to reduce the amount of data; storing the coded data generated in the step of encoding the acoustic frame signal, into a coded data storage section; and decoding the coded data read from the coded data storage section, thereby to generate an output acoustic frame signal having a predetermined length.

In the reproducing-speed converting method, the acoustic frame signal generated in the step of converting the speech speed is encoded in an appropriate method, hereby to reduce the amount of data. Hence, no coded data storage means of a large storage capacity needs to be used. In other words, the method can lower speech speed as much as desired even if the coded data storage means used has but a small storage capacity.

A reproducing-speed converting apparatus according to this invention is designed to process the reproducing speed of an input acoustic signal in real time, thereby converting the reproducing speed to a speed lower than the reproducing speed of the original sound. This apparatus comprises: characteristic detecting means for detecting the characteristic of an acoustic frame signal contained in the input acoustic signal and having a predetermined length; calculation means for calculating a speech-speed converting rate from the characteristic of the input acoustic signal, which has been detected by the characteristic detecting means; signal encoding means for encoding the acoustic frame signal having the predetermined length, thereby to reduce the amount of data; coded data storage means for storing the coded data generated by the signal encoding means; and signal decoding means for decoding the coded data read from the coded data storage means and for converting speech speed in accordance with the speech-speed converting rate calculated by the calculation mans, thereby to generate an output acoustic frame signal having a predetermined length.

In this reproducing-speed converting apparatus, the signal encoding means interpolates encoding parameters. The speech speed can therefore be converted in accordance with the speech-speed converting rate calculated by the calculation means, in the process of decoding the acoustic signal read from the coded data storage means. This apparatus can therefore function as a real-time speech speed converter that can lower speech speed as much as desired even if the coded data storage means has but a small storage capacity.

A producing-speed converting method according to this invention is designed to process the reproducing speed of an input acoustic signal in real time, thereby converting the reproducing speed to a speed lower than the reproducing speed of the original sound. The method comprises the steps of: detecting the characteristic of an acoustic frame signal contained in the input acoustic signal and having a predetermined length; calculating a speech-speed converting rate from the characteristic of the input acoustic signal, which has been detected in the step of detecting the characteristic; encoding the acoustic frame signal having the predetermined length, thereby to reduce the amount of data; storing the coded data generated in the step of encoding the acoustic frame signal, in an coded data storage section; decoding the coded data read from the coded data storage section and converting speech speed in accordance with the speech-speed converting rate calculated in the step of calculating the speech-speed converting rate, thereby to generate an output acoustic frame signal having a predetermined length.

In this reproducing-speed converting method, too, the signal encoding means interpolates encoding parameters are interpolated in the step of encoding the acoustic signal. The speech speed can therefore be converted in accordance with the speech-speed converting rate calculated in the step of calculating the rate, in the process of decoding the acoustic signal read from the coded data storage section. This apparatus can therefore function as a real-time speech speed converter method that can lower speech speed as much as desired even if the coded data storage means has but a small storage capacity.

The present invention makes it possible to delay the output signal without using an output-data storage section of a large storage capacity even if the input acoustic signal is a multi-channel signal or has a high sampling frequency.

DETAILED DESCRIPTION OF THE INVENTION

Embodiments of the present invention will be described, with reference to the accompanying drawings. The first embodiment is a real-time speech speed converter that is designed to process, in real time, an input acoustic signal representing, for example, a speech. The real-time speech speed converter has the structure shown in FIG. 3.

Figure 3:
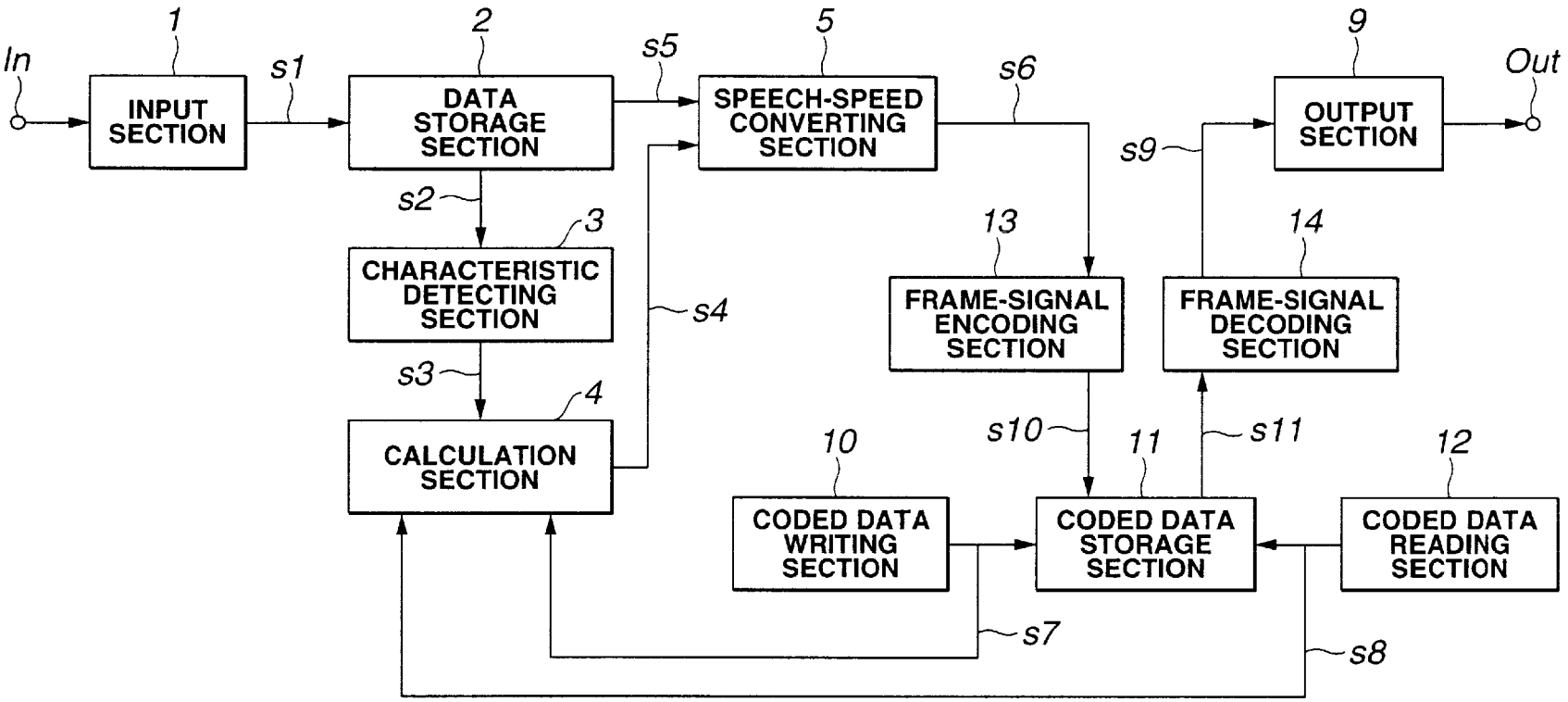
FIG. 3 is a block diagram depicting a real-time speech speed converter that is the first embodiment of the present invention.

As FIG. 3 shows, the real-time speech speed converter comprises a characteristic detecting section 3 and a calculation section 4. The characteristic detecting section 3 detects the characteristic s3 of an acoustic frame signal s2 which is contained in an input acoustic signal s1 and which has a specific length. The characteristic s3 detected is supplied to the calculation section 4. The section 4 calculates a speech-speed converting rate s4 from the characteristic s3.

The real-time speech speed converter comprises a speech-speed converting section 5, a coded data storage section 11, a frame-signal encoding section 13, and a frame-signal decoding section 14. The speech-speed converting section 5 receives an acoustic frame signal s5 and the speech-speed converting rate s4 from the calculation section 4. The speech-speed converting section 5 generates an acoustic frame signal s6 having a specific length, in accordance with the speech-speed converting rate s4. The frame-signal encoding section 13 receives the acoustic frame signal s6 from the speech-speed converting section 5 and encodes the signal s6, generating coded data s10 that is smaller than the data represented by the acoustic frame signal s6. The coded data storage section 11 stores the coded data s10 generated by the frame-signal encoding section 13. The frame-signal decoding section 14 receives the coded data s11 read from the storage section 11 and decodes the coded data s11, generating an output acoustic signal s9 having a particular length.

The real-time speech speed converter has comprises an input section 1 and a data storage section 2. The input section I receives an input acoustic signal s1 via an input terminal In. The data storage section 2 stores the input acoustic signal s1 that has a specific length. Hence, the characteristic detecting section 3 detects the characteristic s3 of the acoustic frame signal s2 stored in the data storage section 2.

The real-time speech speed converter further comprises a coded data writing section 10 and a coded data reading section 12. The coded data writing section 10 generates a write-position signal s7 that designates the position where the coded data s10 should be written in the coded data storage section 11. The coded data reading section 12 generates a read-position signal s8 that designates the position from where the coded data s11 should be read from the coded data storage section 11. The write-position signal s7 and the read-position signal s8 are supplied to the calculation section 4. The calculation section 4 uses the write-position signal s7 and read-position signal s8, thereby calculating the speech-speed converting rate s4.

The real-time speech speed converter has an output section 9. The output section 9 outputs the decoded acoustic frame signal s9 which has been generated by the frame-signal decoding section 14 and which has a particular length.

The input section 1 comprises a microphone, an analog-to-digital converter and the like. The section 1 receives an acoustic signal representing, for example, a speech and converts the signal to a digital PCM acoustic signal s1. The acoustic signal s1 is supplied, in units of frames, to the data storage section 2.

The data storage section 2 is, for example, a RAM or the like. The section 2 stores the input acoustic signal s1 in units of frames. The acoustic frame signal s2 read from the data storage section 2 is supplied to the characteristic detecting section 3. The section 3 detects the characteristic s3 of the acoustic frame signal s2. The input acoustic signal s1 may be, for example, a stereophonic signal. If so, the acoustic frame signal s2 can be half the sum of the left-channel signal and the right-channel signal. The data storage section 2 supplies an input acoustic frame signal s5 having a length $N_1$ to the speech-speed converting section 5.

The characteristic detecting section 3 detects the characteristic s3 of the acoustic frame signal s2, including the type of speech sound, i.e., voiced or voiceless, and the energy of the signal. The characteristic s3 is supplied to the calculation section 4.

The calculation section 4 calculates a speech-speed converting rate s4 from the characteristic s3, write-position signal s7 and read-position signal s8. The characteristic s3 has been generated by the characteristic detecting section 3, the write-position signal s7 has been generated by the coded data writing section 10, and the read-position signal s8 has been generated by the coded data reading section 12.

How the calculation section 4 calculates the speech-speed converting rate s4 will be described in brief (It will be described later in detail how the section 4 calculates the speech-speed converting rate s4.) First, the number of frames that should be read from the coded data storage section 11 is calculated from the write-position signal s7 and the read-position signal s8. Next, it is determined whether each frame represents a voiced speech sound or a voiceless speech sound, from the characteristic s3 the characteristic detecting section 3 has generated.

If it is determined that the frame represents a voiced speech sound or a voiceless speech sound, the frame is counted and the speech-speed converting rate s4 is set at Rv ($0<Rv<1$). The number of frames that may be stored in the coded data storage section 11 at a time is then estimated. Until the number of frames counted increases over the number of frames that can be time-expanded and stored in the section 11 at a time, the speech-speed converting rate remains at Rv ($0<Rv<1$), making it possible to perform time expansion.

If the number of frames counted increases over the number of frames that can be time-expanded, the speech-speed converting rate Rv is set at 1. That is, the rate Rv is set at the value for performing neither the time expansion nor the time compression.

If the characteristic detecting section 3 determines that the frame represents a voiceless speech sound, the number of frames that represent voiced speech sounds is cleared. At this time the coded data storage section 11 may store any frame that should be output. If so, a speech-speed converting rate Ruv ($Ruv>1$). Thus, time compression can be carried out. If the coded data storage section 11 stores no frames that should be output, the speech-speed converting rate is set at the value of 1. Hence, neither the time expansion nor the time compression will be effectuated.

When it is determined that the coded data storage section 11 can store no more frames, the speech-speed converting rate is set at 1. Thus, neither the time expansion nor the time compression will be effectuated. This is how the calculation section 4 serves to convert the speech speed.

Next, the speech-speed converting section 5 performs speech speed conversion on the acoustic frame signal s5 which has length N, and which is stored in the data storage section 2, in accordance with the speech-speed converting rate s4 supplied from the calculation section 4. The section 5 thereby generates an acoustic frame signal s6 for some frames, which has a length $N_2$. How many frames the signal s6 represents depends on the type of frames. If the speech-speed converting rate is 0.5 or more, the signal s6 will represent 0 to 2 frames. The frame lengths ($N_1$ and $N_2$) of the signals input to and output from the speech-speed converting section 5 need not be identical.

Then, the frame-signal encoding section 13 encodes the acoustic frame signal s6, generating coded data s10. The coded data s10 is written into the coded data storage section 11, at the position that has been designated by the has been designated by the write-position signal s7 supplied from the coded data writing section 10.

In the coded data storage section 11, coded data s11 for one frame is read from the position designated by the read-position signal s8 that the coded data reading section 12 has generated. The coded data s11, thus read, is supplied to the frame-signal decoding section 14.

The frame-signal decoding section 14 decodes the coded data s11, thereby generating an output acoustic signal s9. The output acoustic signal s9 is supplied to the output section 9.

The output section 9 outputs the acoustic signal s9 to an external apparatus through the output terminal "Out". The section 9 comprises, for example, a digital-to-analog converter.

The encoding method the frame-signal encoding section 13 performs on the acoustic frame signal s6 can be of any type, if the method can process frame signals having a particular length.

For example, the method may be one designed to encode a high-quality acoustic signal having a high sampling frequency of 44.1/48 kHz, such that the signal maintains the same quality even after the speech-speed converting has been converted. More specifically, the method may be one that effects the audio-signal encoding such as CD-1 (Compact Disc Interactive), MPEG-1 audio layer 3, MPEG-2 AAC, ATRAC or ATRAC3, all described in the so-called green book as listed in the following Table 1. In this case, the storage capacity of the coded data storage section 11 can be reduced to a quarter (1/4) to a tenth (1/10) of the storage capacity required in the conventional real-time speech speed converter of FIG. 1.

TABLE 1

| Encoding method | Sampling frequency | Compression rate |
|---|---|---|
| CD-1 Audio | 48/44.1/32 kHz | 1/4 |
| MPEG-1 Audio Layer 3 | 48/44.1/32 kHz | 1/10 |
| MPEG-2AAC | 48/44.1/32 kHz | 1/10 |
| ATRAC | 44.1 kHz | 1/5 |
| ATRAC 3 | 44.1 kHz | 1/10 |
| G.729(8 kbps) | 8 kHz | 1/16 |
| G.723 (5.3 kbps) | 8 kHz | 1/24 |
| MPEG-4 Audio HVXC (2 kbps) | 8 kHz | 1/64 |

An audio signal of a narrow band, such as a signal of a sampling frequency of 8 kHz, may be subjected to appropriate encoding such as G.729 or G.723 of ITU-T standard, or MPEG-4 Audio HVXC. If the audio signal is so encoded, it will be possible to decrease the storage capacity of the coded data storage section 11.

A parametric encoding method such as MPEG-4 Audio HVXC can convert the speech speed by interpolating the encoding parameters in the process of decoding the acoustic signal. If the parametric encoding method is performed, the real-time speech speed converter can be modified into an efficient circuit configuration, which is a real-time speech speed converter that is the second embodiment of this invention. (The second embodiment will be described later.)

Figure 4:
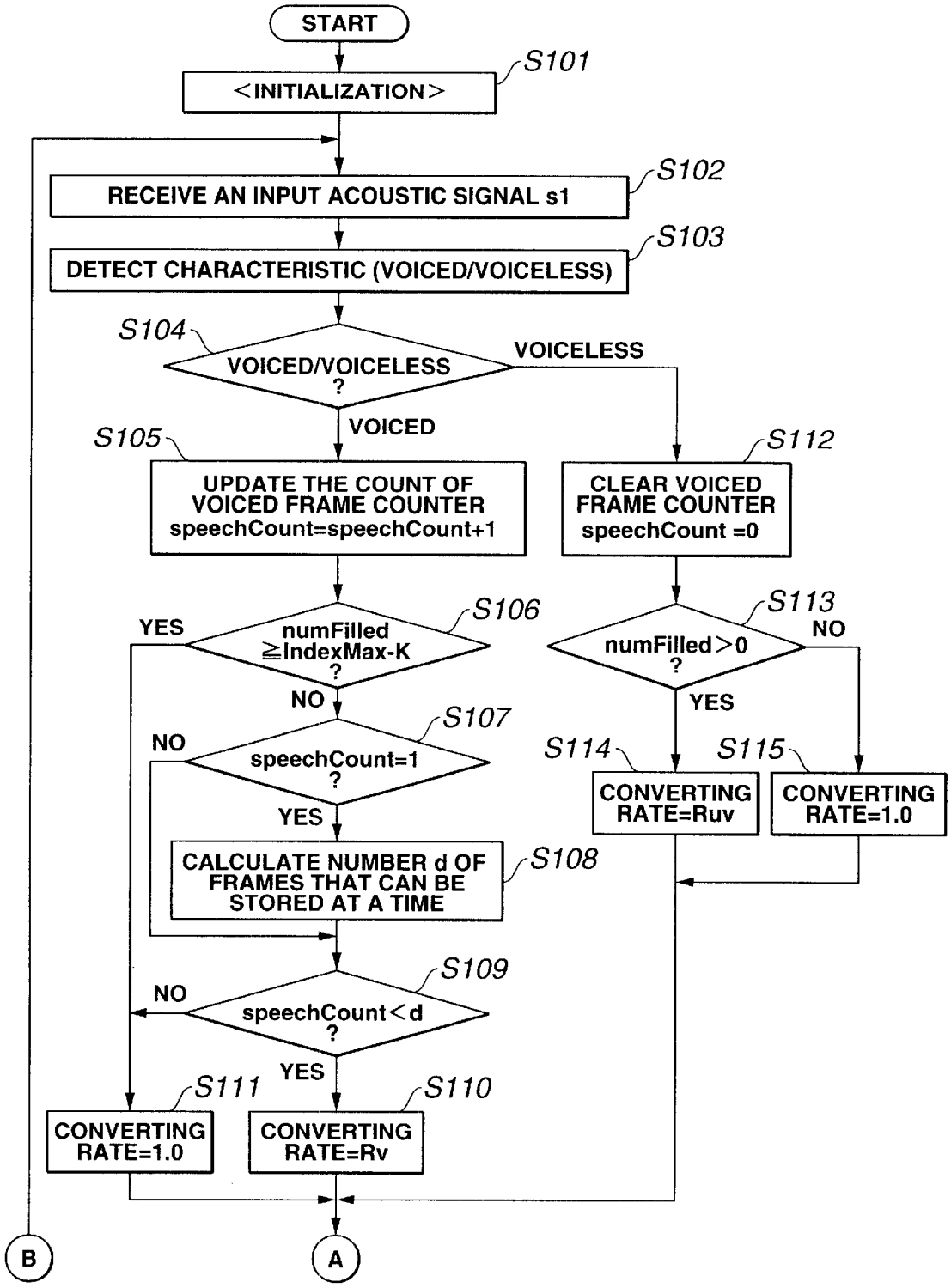
FIG. 4 is a flowchart explaining the first half of the operation performed by the first embodiment.

A method of converting speech speed, which is another embodiment of the invention, will be described with reference to the flowchart of FIGS. 4 and 5. The real-time speech speed converting method is a program that is executed by the CPU incorporated in an ordinary computer. The computer can therefore perform the same function as the real-time speech speed converter described above. The computer comprises a ROM, a RAM, an I/O device, an external memory and the like, which are connected by a bus to the CPU. The program is stored in either the ROM or the external memory.

When the computer executes the program, it performs the function of the real-time speech speed converter illustrated in FIG. 3. How the speech speed converting method is carried out will be explained.

First, in Step S101, the real-time speech speed converter is initialized. In Step S102, the input section 1 receives an input acoustic signal s1 that is a linear PCM acoustic signal. The acoustic signal s1 is stored in the data storage section 2, in the form of an acoustic frame signal of a specific length.

In Step S103, an acoustic frame signal s2 is generated from the acoustic frame signal s1 that is stored in the data storage section 2, and the characteristic detecting section 3 detects the characteristic s3 of the acoustic frame signal s2. As described above, the acoustic frame signal s2 is half the sum of the left-channel signal and the right-channel signal of the acoustic signal s2 if the signal s2 is a stereophonic signal. The data storage section 2 supplies an input acoustic frame signal s5 having a length $N_1$ to the speech-speed converting section 5. As pointed out above, the characteristic s3 of the section 3 has detected includes the type of speech sound, i.e., voiced or voiceless, and the energy of the signal.

The characteristic s3 detected by the characteristic detecting section 3 is supplied to the calculation section 4. Meanwhile, the calculation section 4 receives the write-position signal s7 (write index) from the coded data writing section 10, and the read-position signal s8 (read index) from the coded data reading section 12. The section 4 calculates a speech-speed converting rate s4 from the characteristic s3, write-position signal s7 and read-position signal s8, as will be explained below in detail.

The coded data storage section 11 may be a ring buffer. In this case, the calculation section 4 uses the write-position signal (write index) and the read-position signal (read index), thus calculating the number (num Filled) of frames that should be read from the coded data storage section 11 in accordance with the following equation (2):

$$\text{numFilled}=(\text{writeindex}+\text{indexMax}-\text{readIndex})\%\text{indexMax} \quad (2)$$

In the equation (2), indexMax is the upper limits of the write-position signal (write index) and read-position signal (read index), i.e., the storage capacity of the coded data storage section 11 that is a ring buffer. More precisely, the calculation section 4 adds storage capacity indexMax to the write-position signal (write index), subtracts the read-position signal (read index) from the resultant sum. The section 4 then divides the result of the subtraction by the storage capacity indexMax. The remainder obtained in the division is the number (numFilled) of frames that should be read from the storage section 11.

If it is determined that the frame represents a voiced speech sound, from the characteristic s3 detected by the frame represents a voiced speech sound, the calculation section 4 increments the speech count of a voiced frame counter (not shown) in Step S105. Then, in Step S106, the calculation section 4 determines whether the amount of data stored in the coded data storage section 11 is equal to or greater than the storage capacity of the section 11, in accordance with the following equation (3):

$$numFilled>=indexMax-K \quad (3)$$

In the equation (3), K is the number of frames each having an appropriate margin.

If it is determined in Step S106 that the amount of data stored in the coded data storage section 11 is less than the storage capacity of the section 11, the calculation section 4 determines in Step S107 whether the frame has changed, now representing a voiced speech sound. If the frame has changed, from one representing a voiceless sound to a voiced sound, that is, if speechCount=1, the calculation section 4 estimates the number d of frames that may be stored in the coded data storage section 11 at a time even if the speech-speed converting rate s4 is continuously increased from 0 to 1 (0<Rv<1) to accomplish time expansion. More specifically, the number d is estimated in Step S108 in accordance with the following equation (4):

$$d=(int)((Rv/(1-Rv))\times(indexMax-numFilled)) \quad (4)$$

In Step S109 it is determined whether the count, speechCount, of the voiced frame counter is greater than the number d of frames that may be stored in the coded data storage section 11 at a time. If the count, speechCount, is less than the number d of frames, the calculation section 4 sets, in Step S110, the speech-speed converting rate s4 at a value within the range of (0<Rv<1), thereby to accomplish time expansion. If the count, speechCount, is not less than the number d of frames, the calculation section 4 sets, in Step S111, the speech-speed converting rate s4 at a value of 1, thereby to accomplish neither time expansion nor time compression.

The characteristic detecting section 3 may determine in Step S104 that the frame represents a voiceless speech sound. In this case, the calculation section 4 clears the count, speechCount, of the voiced frame counter in Step S112. In Step S113, the calculation section 4 determines in Step S113 whether the coded data storage section 11 stores any frames, numFilled, which should be read. If the section 11 stores any frames that should be read, or if numFilled>0, the section 11 sets the speech-speed converting rate at value Ruv (Ruv>1) in Step S114, so that time compression may be carried out. If the section 11 stores no frames that should be read, the section 11 sets the speech-speed converting rate at value of 1 in Step S115. In this case, neither time expansion nor the time compression will be accomplished.

In Step S106, it may be determined that the amount of data stored in the coded data storage section 11 is not less than the storage capacity of the section 11, that is, the following equation (5) may hold true. If so, the calculation section 4 sets, in Step S111, the speech-speed converting rate s4 at a value of 1, thereby to accomplish neither time expansion nor time compression.

$$numFilled>indexMax-K \quad (5)$$

In the equation (5), K is the number of frames each having an appropriate margin. How the calculation section 4 calculates the speech-speed converting rate has been explained in detail.

Figure 5:
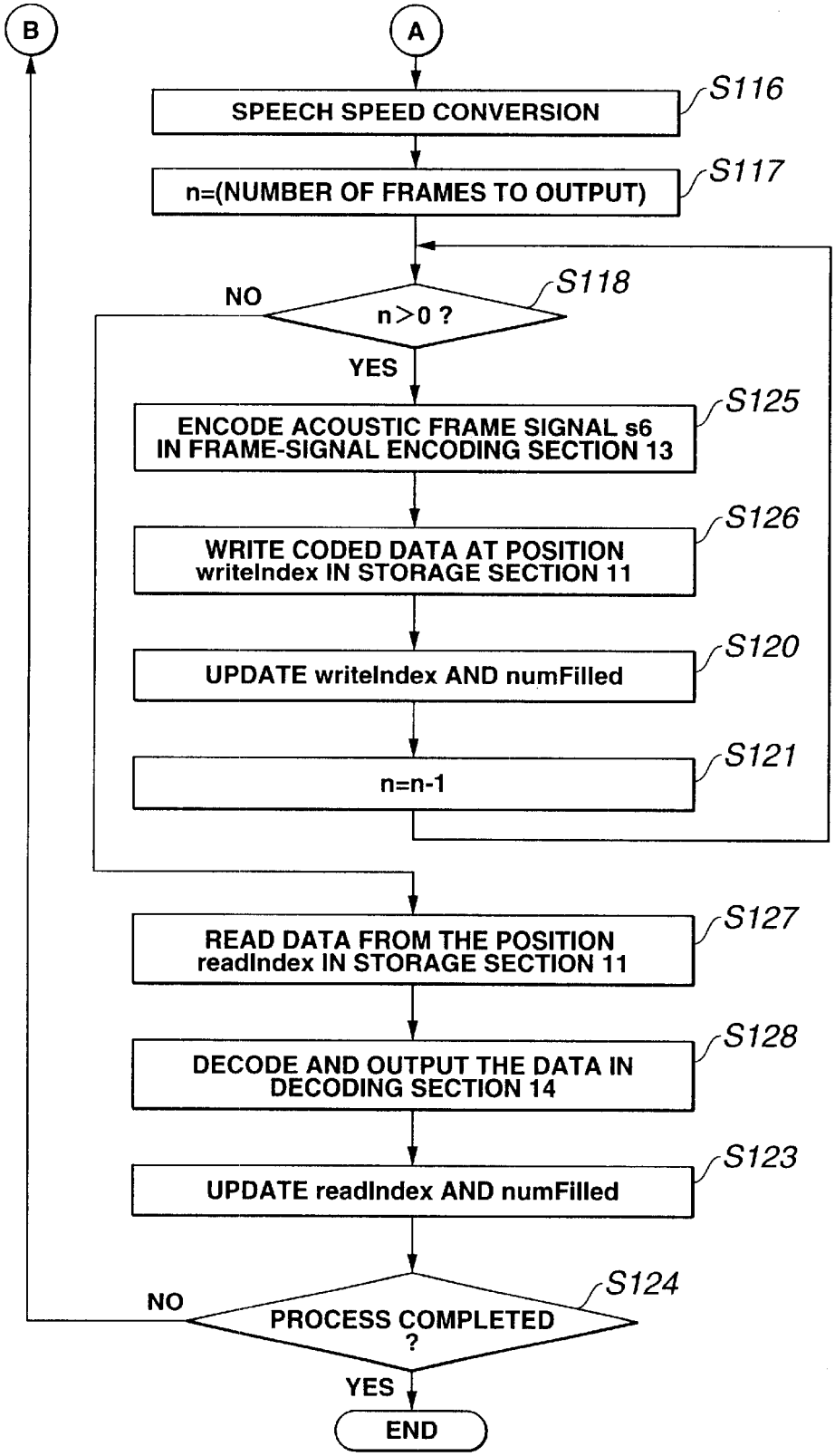
FIG. 5 is a flowchart explaining the latter half of operation performed by the first embodiment.

As shown in FIG. 5, in Step S116 the speech-speed converting section 5 performs speech speed conversion on the acoustic frame signal s5 which has length $N_1$ and which is stored in the data storage section 2, in accordance with the speech-speed converting rate s4 supplied from the calculation section 4. The section 5 thereby generates an acoustic frame signal s6 for some frames, which has a length $N_2$.

In Step S117 it is determined that the number of frames that should be output is n. In Step S118, it is determined whether n is greater than 0. If YES in Step S118, the operation goes to Step S125. In Step S125, the frame-signal encoding section 13 encodes the acoustic frame signal s6 that has undergone the speech speed conversion, thereby generating coded data s10. In Step S126, the coded data s10 is written into the coded data storage section 11. The write position writeIndex is designated by the write-position signal s7 generated by the output-data writing section 6. The write position writeindex is updated as indicated by the following equation (6), every time one-frame data is written into the coded data storage section 11.

$$writeIndex=(writeindex+1+indexMax)\%indexMax \quad (6)$$

In Step S120, the number of frames to be read, numFilled, is updated.

In Step S121, the frame n-1 preceding the frame is processed. In Step S118, it is determined whether the number of frames that should be output decreases to 0 or not. If YES, the operation goes to Step S127. In Step S127, coded data s11 for one frame is read from the coded data storage section 11, more precisely from the read position readIndex designated by the read-position signal s8 that has been supplied from the coded data reading section 12. Thereafter, the frame-signal decoding section 14 decodes the coded data s11, generating an output acoustic signal s9, in Step S128. The output acoustic signal s9 is supplied to the output section 9. In Step S123, the read position, readIndex, is updated as indicated by the following equation (7), every time one-frame data is read.

$$readIndex=(readIndex+1+indexMax)\%indexMax \quad (7)$$

The sequence of the steps described above is repeated until it is determined in Step S124 that the process has been completed.

Figure 1:
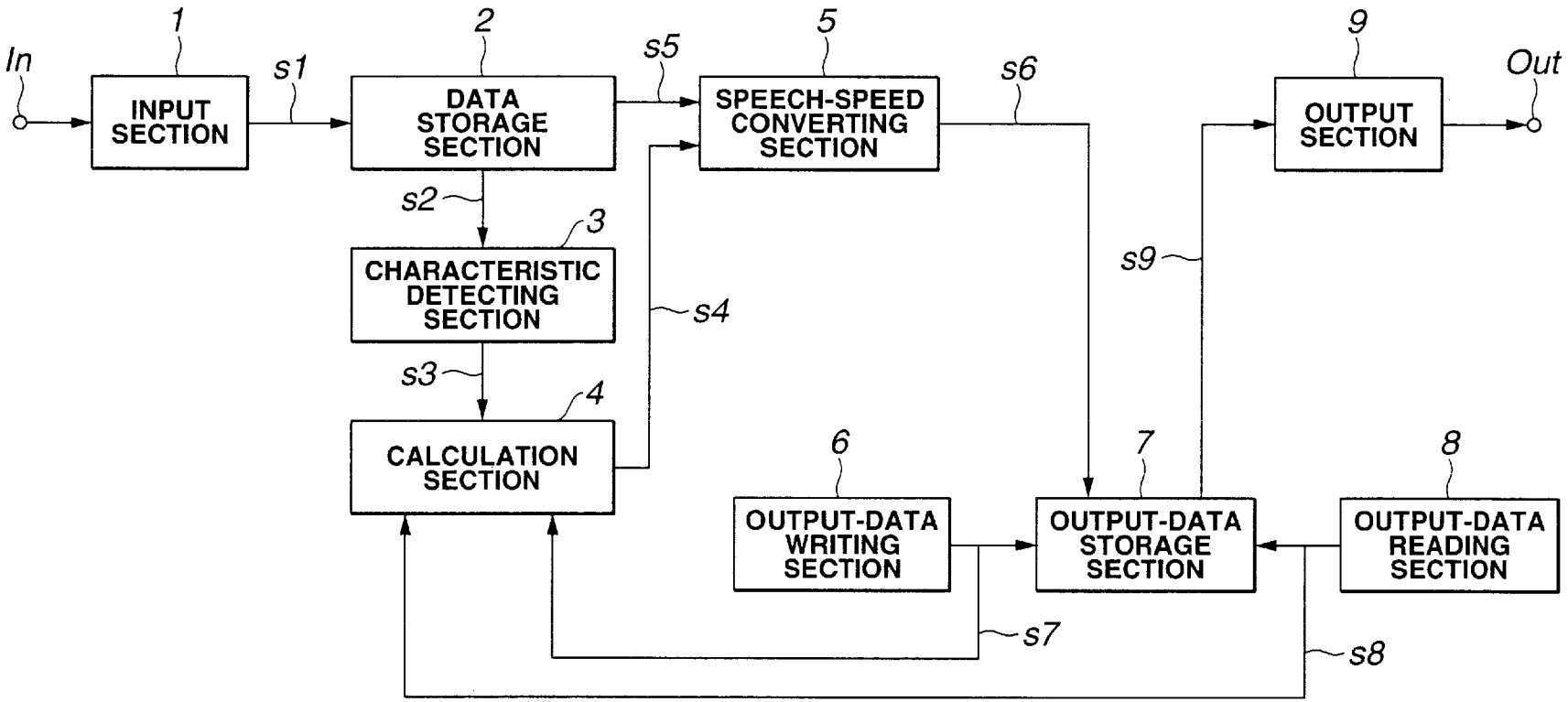
FIG. 1 is a block diagram showing a conventional real-time speech speed converter.
Figure 2:
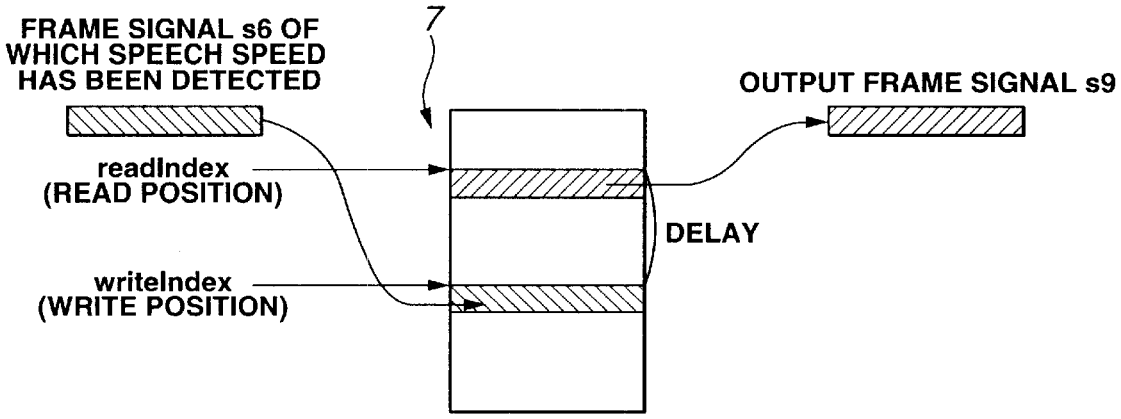
FIG. 2 is a diagram illustrating how the output data is stored in the output-data storage section incorporated in the conventional real-time speech speed converter.
Figure 6:
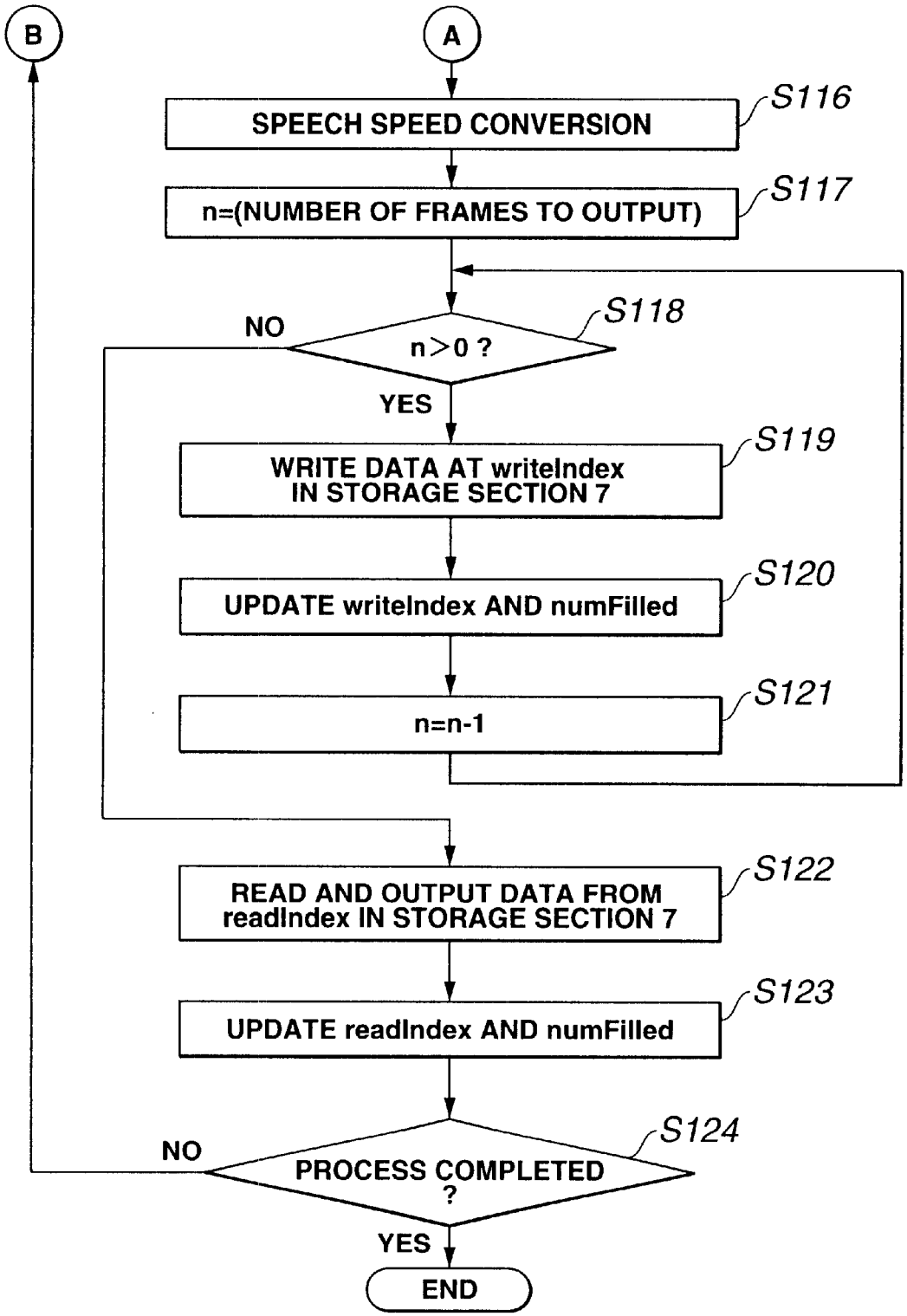
FIG. 6 is a flowchart explaining how the conventional real-time speech speed converter operates.

An example of a real-time speech speed converting method, which may be performed in the conventional real-time speech speed converter of FIG. 1, will be described in comparison with the above-described method according to the present invention. After Steps S101 to S115 shown in FIG. 4, Steps S116 to S124 shown in FIG. 6 are carried out. Steps S116 to S124 will be described in comparison with the sequence of steps that is illustrated in FIG. 5.

As shown in FIG. 5, the operation goes to Step S125 if it is determined in Steps S117 and S118 that n frames should be output. In Step S125, the frame-signal encoding section 13 encodes the acoustic frame signal s6 that has undergone the speech speed conversion, generating coded data s10. In Step S126, the coded data s10 is written into the coded data storage section 11. In the conventional method, however, the acoustic frame signal s6 is not encoded and written into the output-data storage section 7, at the write position, writeIndex, designated by the write-position signal s7. Therefore, in the conventional method for converting the speech speed, coded data is not decoded as practiced in Steps S127 and S128 both shown in FIG. 5. Instead, in Step S122, the data is read from the read position, readIndex, in the output-data storage section 7.

In the real-time speech speed converting method, which has been described with reference to FIGS. 4 and 5, the data for one frame is encoded before it is written at one index in the coded data storage section 11. Therefore, the storage means needs only to store less data than in the conventional method, in order to delay the output signal as much as in the conventional method.

The second embodiment of the present invention will be described. The second embodiment is a real-time speech speed converter, too, which is designed to process an acoustic signal representing a speech sound in real time. The second embodiment has the structure illustrated in FIG. 7.

The second embodiment differs from the first embodiment in two respects. First, the speech-speed converting section 5 is not incorporated, and the frame-signal decoding section 14 converts the speech speed. Second, the frame-signal encoding section 13 encodes the acoustic frame signal s5 read from the data storage section 2, generating the coded data s10, and the coded data s10 is written into the coded data storage section 11.

The frame-signal decoding section 14 receives the coded data s11 read from the storage section 11. Using the speech-speed converting rate s4, the section 14 performs speech speed conversion on the coded data s11.

The method the frame-signal encoding section 13 performs to encode the acoustic frame signal s5 is a parametric encoding method such as MPEG-4 Audio HVXC. The parametric encoding method can convert the speech speed by interpolating the encoding parameters in the process of decoding the acoustic signal.

A real-time speech speed converting method, which is another embodiment of this invention, will be described with reference to the flowchart of FIGS. 4 and 8. The real-time speech speed converting method is a program, too. This program is executed by the CPU incorporated in an ordinary computer. The computer can therefore perform the same function as the real-time speech speed converter shown in FIG. 7. The computer comprises a ROM, a RAM, an I/O device, an external memory and the like, which are connected by a bus to the CPU. The program is stored in either the ROM or the external memory.

Figure 7:
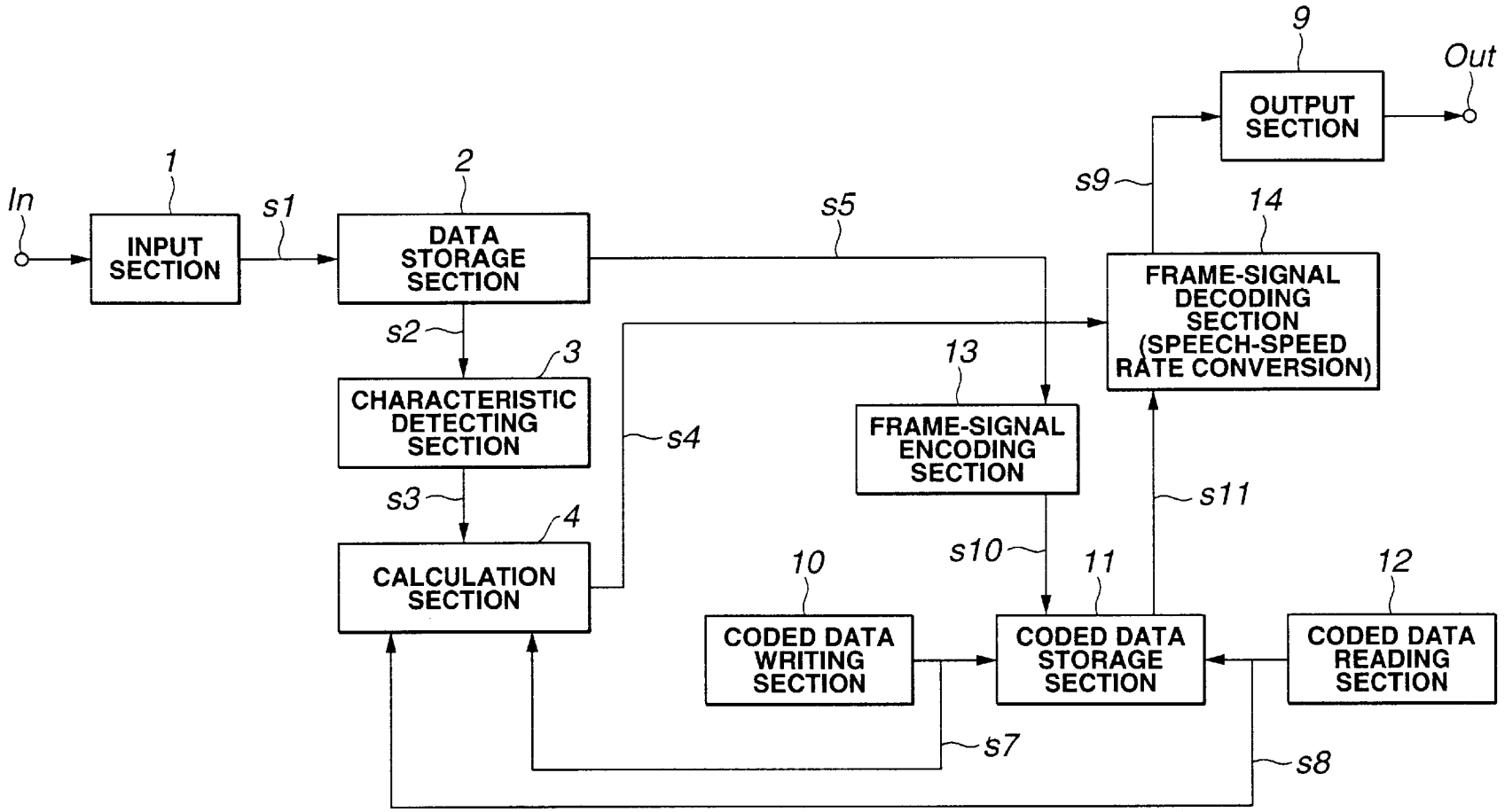
FIG. 7 is a block diagram depicting a real-time speech speed converter that is the second embodiment of the present invention.

When the computer executes the program, it performs the function of the real-time speech speed converter illustrated in FIG. 7. The steps identical to those shown in FIG. 4 are performed until the sequence of steps shown in FIG. 6 is started. The steps shown in FIG. 4 will not be described here.

First, in Step S129, the frame-signal encoding section 13 receives the acoustic frame signal s5 having a specific length $N_1$ and read from the data storage section 2. The section 13 encodes the acoustic frame signal s5, generating coded data s10. In Step S130, the coded data s10 is written into the coded data storage section 11, at the write position writeindex is designated by the write-position signal s7 generated by the coded data writing section 10. In Step S120, the write position, writeIndex, is updated as indicated by the following equation (8), every time one-frame data is written.

$$\text{writeIndex}=(\text{writeindex}+1+\text{indexMax})\%\text{indexMax} \quad (8)$$

Until an acoustic frame signal is input, coded data s11 is read from the coded data storage section 11 in Step S131, more precisely from the read position, readIndex, designated by the read-position signal s8 that has been supplied from the coded data reading section 12. In Step S133, the frame-signal decoding section 14 receives the coded data s11 read from the storage section 11. Using the speech-speed converting rate s4, the section 14 performs speech speed conversion on the coded data s11. In Step S123, the read position, readIndex, is updated as indicated by the following equation (9), every time one-frame data is read.

$$\text{readIndex}=(\text{readIndex}+1+\text{indexMax})\%\text{indexMax} \quad (9)$$

The frame-signal decoding section 14 generates an output acoustic signal s9 from the coded data s11. In Step S134, the output acoustic signal s9 is supplied to the output section 9.

Figure 8:
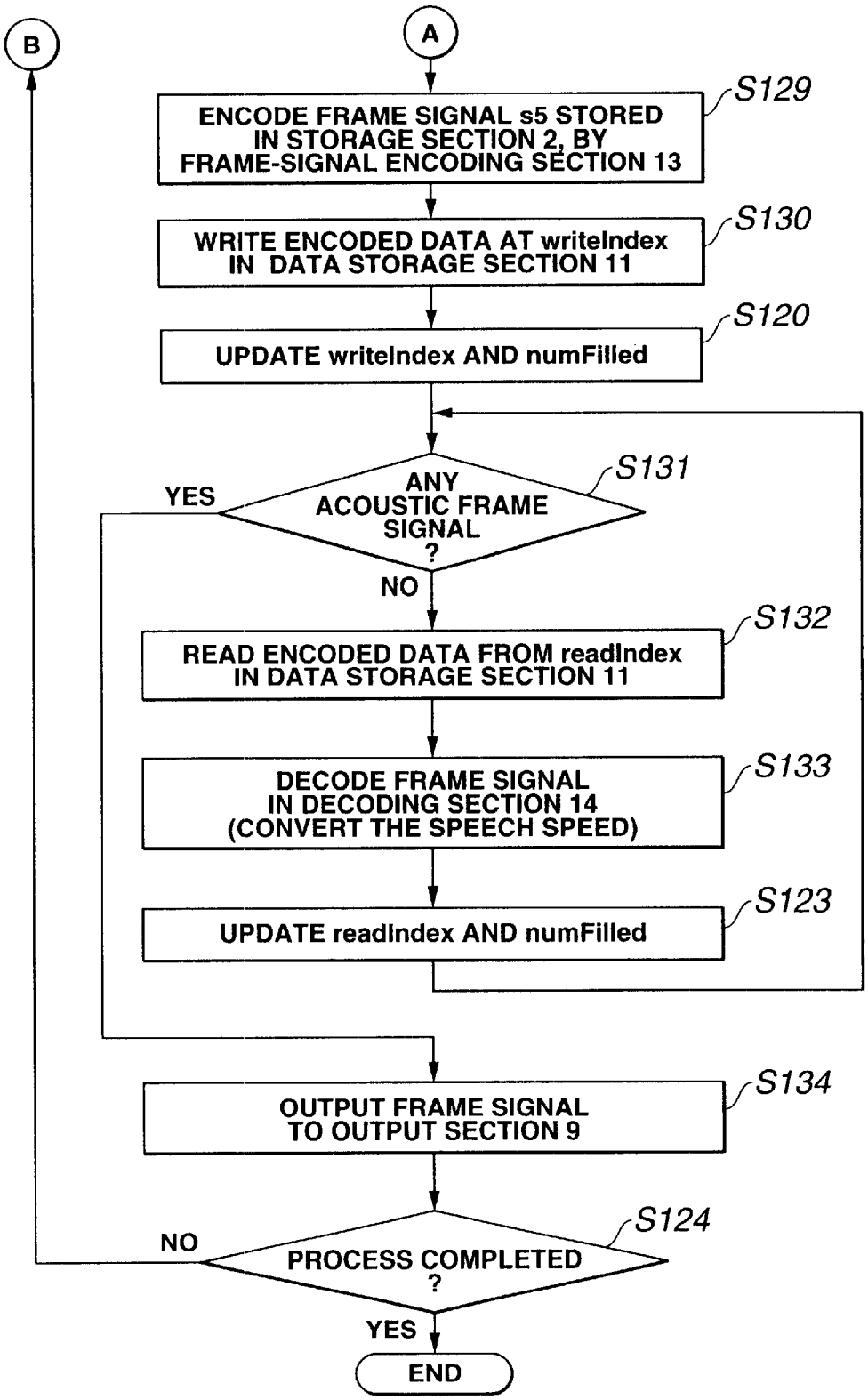
FIG. 8 is a flowchart explaining the latter half of operation performed by the second embodiment.

In the real-time speech speed converter of FIG. 7 and the method shown in FIG. 8, the speech speed is converted by interpolating the encoding parameters in the process of decoding the acoustic signal. Both the converter and the method can efficiently delay the output signal as much as is desired.

What is claimed is:

1. An apparatus for processing a reproducing speed of an input acoustic signal in real time to convert the reproducing speed to a speed lower than a reproducing speed of an original sound, the apparatus comprising:

characteristic detecting means for detecting a characteristic of an acoustic frame signal having a predetermined length contained in the input acoustic signal;

calculation means for calculating a speech-speed converting rate from the characteristic of the input acoustic signal detected by the characteristic detecting means;

speech-speed converting means for performing speech-speed conversion on the input acoustic frame signal in accordance with the speech-speed converting rate calculated by the calculation means to generate a speech-speed converted acoustic frame signal;

signal encoding means for encoding the speech-speed converted acoustic frame signal to reduce an amount of data;

coded data storage means for storing the coded data generated by the signal encoding means; and signal decoding means for decoding the coded data read from the coded data storage means to generate an output acoustic frame signal having a predetermined length.

2. The apparatus according to claim 1, further comprising: input means for receiving the input acoustic signal; and data storage means for storing the acoustic frame signal having a predetermined length received by the input means, wherein the characteristic detecting means detects the characteristic of the acoustic frame signal stored in the data storage means.

3. The apparatus according to claim 1, further comprising: coded data writing means for generating a write position signal designating a write position in the coded data storage means and writing the coded data at the write position designated by the write position signal; and coded data reading means for generating a read position signal designating a read position in the coded data storage means and reading the coded data from the read position designated by the read position signal, wherein the calculation means calculaces the speech-speed converting rate by using the characteristic, the write position signal, and the read position signal.

4. A method of processing a reproducing speed of an input acoustic signal in real time to convert the reproducing speed to a speed lower than a reproducing speed of an original sound, the method comprising the steps of:

detecting a characteristic of an acoustic frame signal having a predetermined length contained in the input acoustic signal;

calculating a speech-speed converting rate from the characteristic of the input acoustic signal detected in the step of detecting the characteristic;

performing speech-speed conversion on the acoustic frame signal in accordance with the speech-speed converting rate calculated in the step of calculating the speech-speed converting rate to generate a speech-speed converted acoustic frame signal;

encoding the speech-speed converted acoustic frame signal to reduce an amount of data;

storing the coded data generated in the step of encoding the speech-speed converted acoustic frame signal in a coded data storage section; and decoding the coded data read from the coded data storage section to generate an output acoustic frame signal having a predetermined length.

5. An apparatus for processing a reproducing speed of an input acoustic signal in real time to convert the reproducing speed to a speed lower than a reproducing speed of an original sound, the apparatus comprising:

characteristic detecting means for detecting a characteristic of an acoustic frame signal having a predetermined length contained in the input acoustic signal;

calculation means for calculating a speech-speed converting rate from the characteristic of the input acoustic signal detected by the characteristic detecting means;

signal encoding means for encoding the acoustic frame signal having the predetermined length to reduce an amount of data;

coded data storage means for storing the coded data generated by the signal encoding means; and signal decoding means for decoding the coded data read from the coded data storage means and for converting speech speed in accordance with the speech-speed converting rate calculated by the calculation means to generate an output acoustic frame signal having a predetermined length.

6. The apparatus according to claim 5, further comprising: input means for receiving the input acoustic signal; and data storage means for storing the acoustic frame signal having a predetermined length received by the input means, wherein the characteristic detecting means detects the characteristic of the acoustic frame signal stored in the coded data storage means.

7. The apparatus according to claim 5, further comprising: coded data writing means for generating a write position signal designating a write position in the coded data storage means and writing the coded data at the write position designated by the write position signal; and coded data reading means for generating a read position signal designating a read position in the data storage means and reading the coded data from the read position designated by the read position signal, wherein the calculation means calculates the speech-speed converting rate by using the characteristic, the write position signal, and the read position signal.

8. The apparatus according to claim 5, wherein encoding parameters are interpolated in the signal encoding means during the decoding of the acoustic signal to convert the speech-speed.

9. A method of processing a reproducing speed of an input acoustic signal in real time to convert the reproducing speed to a speed lower than a reproducing speed of an original sound, the method comprising the steps of:

detecting a characteristic of an acoustic frame signal having a predetermined length contained in the input acoustic signal;

calculating a speech-speed converting rate from the characteristic of the input acoustic signal detected in the step of detecting the characteristic;

encoding the acoustic frame signal having the predetermined length to reduce an amount of data;

storing the coded data generated in the step of encoding the acoustic frame signal into a coded data storage section; and decoding the coded data read from the coded data storage section and converting speech speed in accordance with the speech-speed converting rate calculated in the step of calculating the speech-speed converting rate to generate an output acoustic frame signal having a predetermined length.

* * * * *